US006645054B2

(12) United States Patent
Raffo, Sr.

(10) Patent No.: US 6,645,054 B2
(45) Date of Patent: Nov. 11, 2003

(54) PORTABLE DRUM SANDER

(76) Inventor: Robert J. Raffo, Sr., 81 Tindall Rd., Robbinsville, NJ (US) 08691

( * ) Notice: Subject to any disclaimer, the term of this patent is extended or adjusted under 35 U.S.C. 154(b) by 0 days.

(21) Appl. No.: 10/116,292

(22) Filed: Apr. 4, 2002

(65) Prior Publication Data

US 2003/0190876 A1 Oct. 9, 2003

(51) Int. Cl.[7] ..... B24B 7/28
(52) U.S. Cl. ..... 451/182; 451/241
(58) Field of Search ..... 451/182, 178, 451/241, 358

(56) References Cited

U.S. PATENT DOCUMENTS

| | | | | |
|---|---|---|---|---|
| 273,970 A | * | 3/1883 | Doane | 451/178 |
| 372,833 A | * | 11/1887 | Weimer | 451/241 |
| 1,096,933 A | * | 5/1914 | McCrum | 451/178 |
| 2,052,837 A | * | 9/1936 | Markaroff | 451/241 |
| 2,337,718 A | * | 12/1943 | Hoppes | 451/241 |
| 2,483,369 A | * | 9/1949 | Loucony et al. | 451/178 |
| 2,598,020 A | * | 5/1952 | Rutherford | 451/241 |
| 5,624,306 A | * | 4/1997 | Casillas et al. | 451/358 |
| 5,842,913 A | * | 12/1998 | Nemazi | 451/499 |

FOREIGN PATENT DOCUMENTS

| | | | | |
|---|---|---|---|---|
| FR | 0633399 | * | 1/1928 | 451/178 |

* cited by examiner

*Primary Examiner*—Robert A. Rose
(74) *Attorney, Agent, or Firm*—Adams Evans P.A.

(57) ABSTRACT

A portable drum sander, including a base, a drum mounted for rotation on the base for carrying at least one grade of sand paper on a peripheral surface thereof, a feed table carried on the base and having a slot therein through which the drum is exposed for rotating contact with a workpiece to be sanded. The feed table includes an infeed table segment upstream of the slot and an outfeed table segment downstream of the slot for supporting the workpiece during passage over the slot in contact with the drum, and a pivot mounting the feed table adjacent a downstream end of the outfeed table segment for pivotal movement of the feed table to a desired height with reference to the drum. A height adjustment lock cooperates with the infeed table segment for locking the feed table into a locked position at the desired height with reference to the drum.

19 Claims, 7 Drawing Sheets

PORTABLE DRUM SANDER

TECHNICAL FIELD AND BACKGROUND OF THE INVENTION

This invention relates to a portable drum sander, particularly designed to be inexpensive and useful for a wide variety of sanding projects, such as scroll work and other small pieces, as well as larger projects where no limitation on the height of the workpiece is a condition. The sander operates in a manner similar to a jointer or planer, i.e., the workpiece is fed across the feed table and over an exposed sanding drum while applying sufficient pressure to maintain the workpiece firmly on the feed table. A simple height adjustment mechanism reduces cost and permits fast and accurate adjustment. The drum can be relatively wide, for example, 18 inches, and is sufficiently wide that as many as three different grits of sandpaper can be applied to different widthwise segments so that coarse, intermediate and finish sanding steps can be carried out in sequence without stopping the sander to change sandpaper. In many respects the drum sander operates like a belt sander.

SUMMARY OF THE INVENTION

Therefore, it is an object of the invention to provide a drum sander that operates like a jointer or planer.

It is another object of the invention to provide a drum sander that operates like a belt sander.

It is another object of the invention to provide a drum sander that has a simple height adjustment mechanism.

It is another object of the invention to provide a drum sander that can accommodate multiple sandpaper grades simultaneously.

It is another object of the invention to provide a drum sander that can accommodate workpieces with no height limitations.

It is another object of the invention to provide a drum sander that has a fixed offset between the height of the infeed table segment and the outfeed table segment.

These and other objects of the present invention are achieved in the preferred embodiments disclosed below by providing a portable drum sander comprising a base, a drum mounted for rotation on the base for carrying at least one grade of sandpaper on a peripheral surface thereof, and a feed table carried on the base and having a slot therein through which the drum is exposed for rotating contact with a workpiece to be sanded. The feed table includes an infeed table segment upstream of the slot and an outfeed table segment downstream of the slot for supporting the workpiece during passage over the slot in contact with the drum, and a pivot mounting the feed table adjacent a downstream end of the outfeed table segment for pivotal movement of the feed table to a desired height with reference to the drum. A height adjustment lock cooperates with the infeed table segment for locking the feed table into a locked position at the desired height with reference to the drum.

According to one preferred embodiment of the invention, a motor is mounted on the base and connected to the drum for supplying power to rotate the drum.

According to another preferred embodiment of the invention, the base comprises interconnected front, rear and left and right side plates forming a frame across which the drum extends and over which the feed table is mounted.

According to yet another preferred embodiment of the invention, the height adjustment lock comprises a lifter plate supporting the feed table and mounted for vertical movement relative to the front plate of the base for varying the height of the feed table within a range of vertical motion relative to the drum. At least one locking device is carried the front plate for locking the lifter plate into a desired position within the range of motion.

According to yet another preferred embodiment of the invention, the lifter plate supports the feed table adjacent an upstream end of the infeed segment of the feed table. The front plate includes at least one vertically-oriented slot, and the locking device comprises a bolt extending through the slot and threaded to the lifter plate, the bolt being rotatable between the locked position and an unlocked position for adjusting the height of the feed table.

According to yet another preferred embodiment of the invention, the lifter plate supports the feed table adjacent an upstream end of the infeed segment of the feed table. The front plate includes at least two laterally spaced-apart, vertically-oriented slots, and the locking device comprises at least first and second bolts extending, respectively, through the at least two slots and threaded to the lifter plate, the bolts each being rotatable between the locked position and an unlocked position for adjusting the height of the feed table.

Preferably, the locking device comprises three bolts extending, respectively, through three slots and threaded to the lifter plate, the bolts each being rotatable between the locked position and an unlocked position for adjusting the height of the feed table.

According to yet another preferred embodiment of the invention, the bolts include enlarged heads with peripheral indentations thereon for permitting manual rotation of the bolts.

According to yet another preferred embodiment of the invention, a dust port is positioned in one of the left or right side plates.

According to yet another preferred embodiment of the invention, the outer peripheral surface of the drum is covered with a multiplicity of closely-spaced flexible hooks for receiving sanding paper having a multiplicity of mating filament loops carried on the back thereof.

According to yet another preferred embodiment of the invention, the feed table is exposed for permitting sanding of workpieces without a height limitation.

According to yet another preferred embodiment of the invention, the drum is adapted for receiving and simultaneously carrying at least two different grades of sandpaper side-by-side for permitting first and second sanding steps to be carried out on the sander without changing sandpaper.

According to yet another preferred embodiment of the invention, the outfeed table segment is upwardly vertically offset relative to the infeed table segment.

According to yet another preferred embodiment of the invention, laterally-extending slots are provided in the infeed table segment and in the outfeed table segment for receiving a guide fence.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
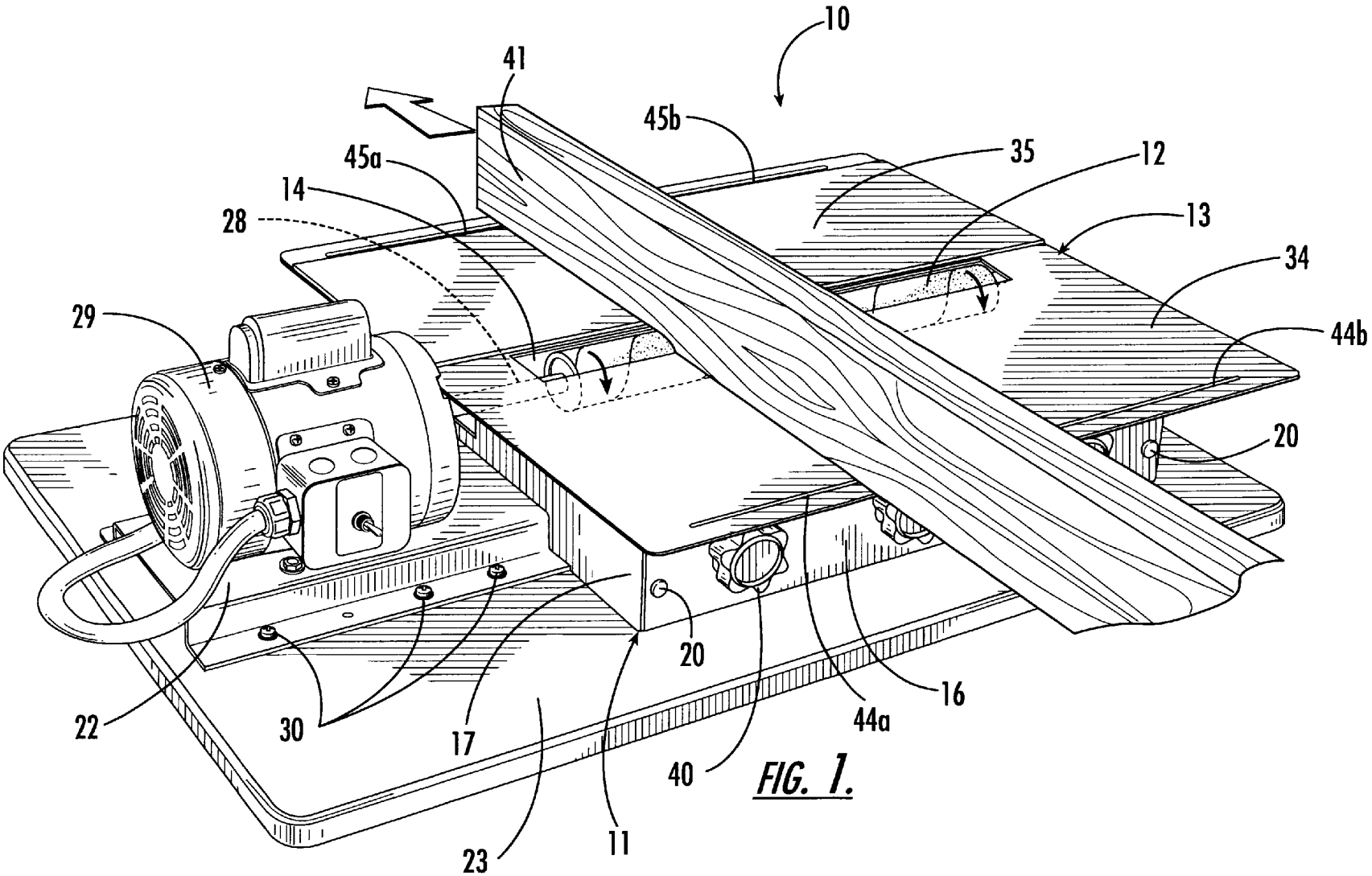
FIG. 1 is a perspective view of a preferred portable drum sander according to the invention.
Figure 3:
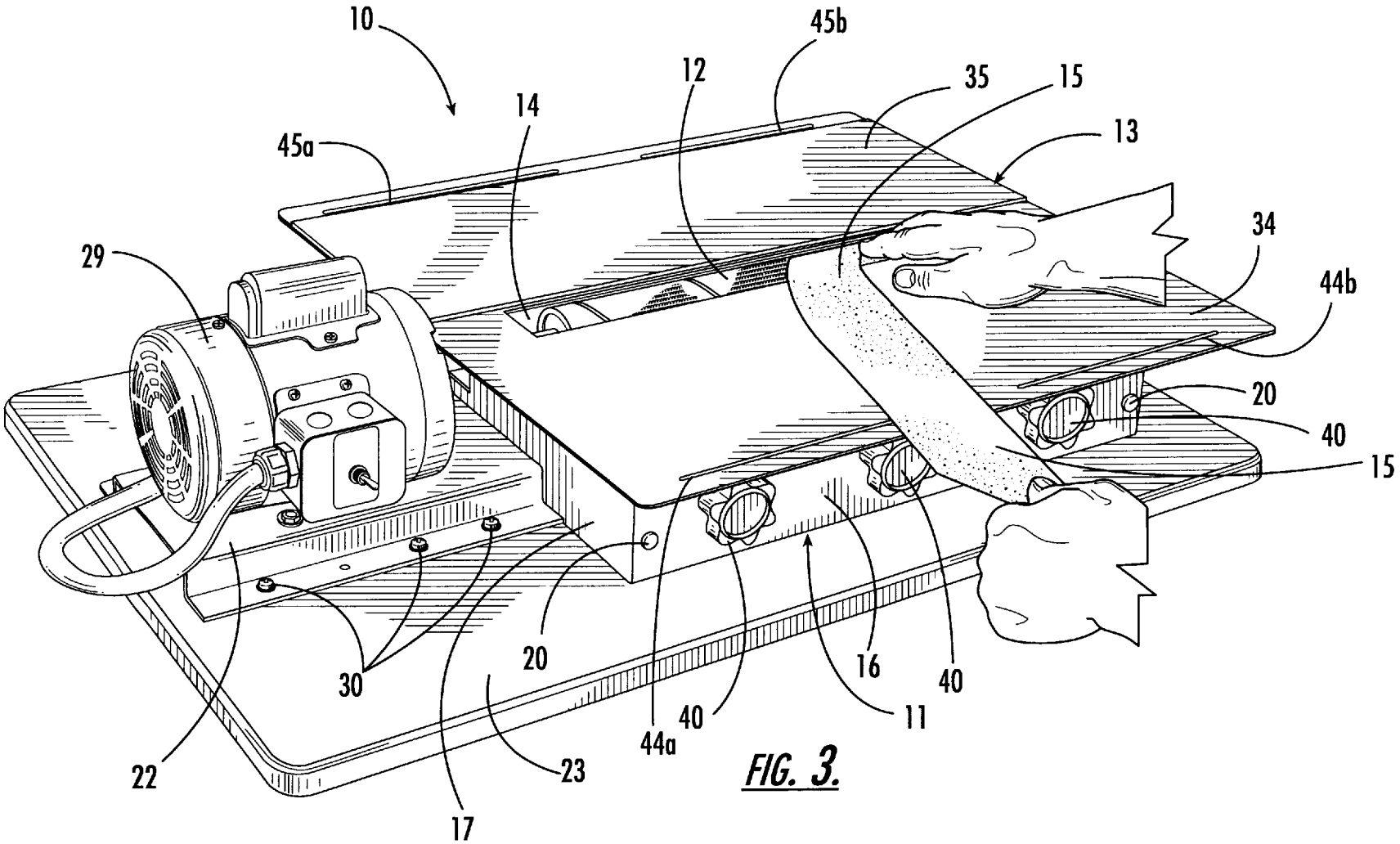
FIG. 3 is a perspective view of the preferred portable drum sander shown in FIG. 1, with sandpaper being positioned on the sanding drum.

Referring now specifically to the drawings, a preferred portable drum sander according to the present invention is illustrated in FIG. 1 and shown generally at reference numeral 10. The sander 10 comprises a base 11, a rotatable sanding drum 12 mounted on the base 11, and a feed table 13 having a rectangular slot 14 through which the drum 12 is exposed. A sheet of sandpaper 15 is wrapped around and attached to the drum 12, as shown in FIG. 3.

Figure 2:
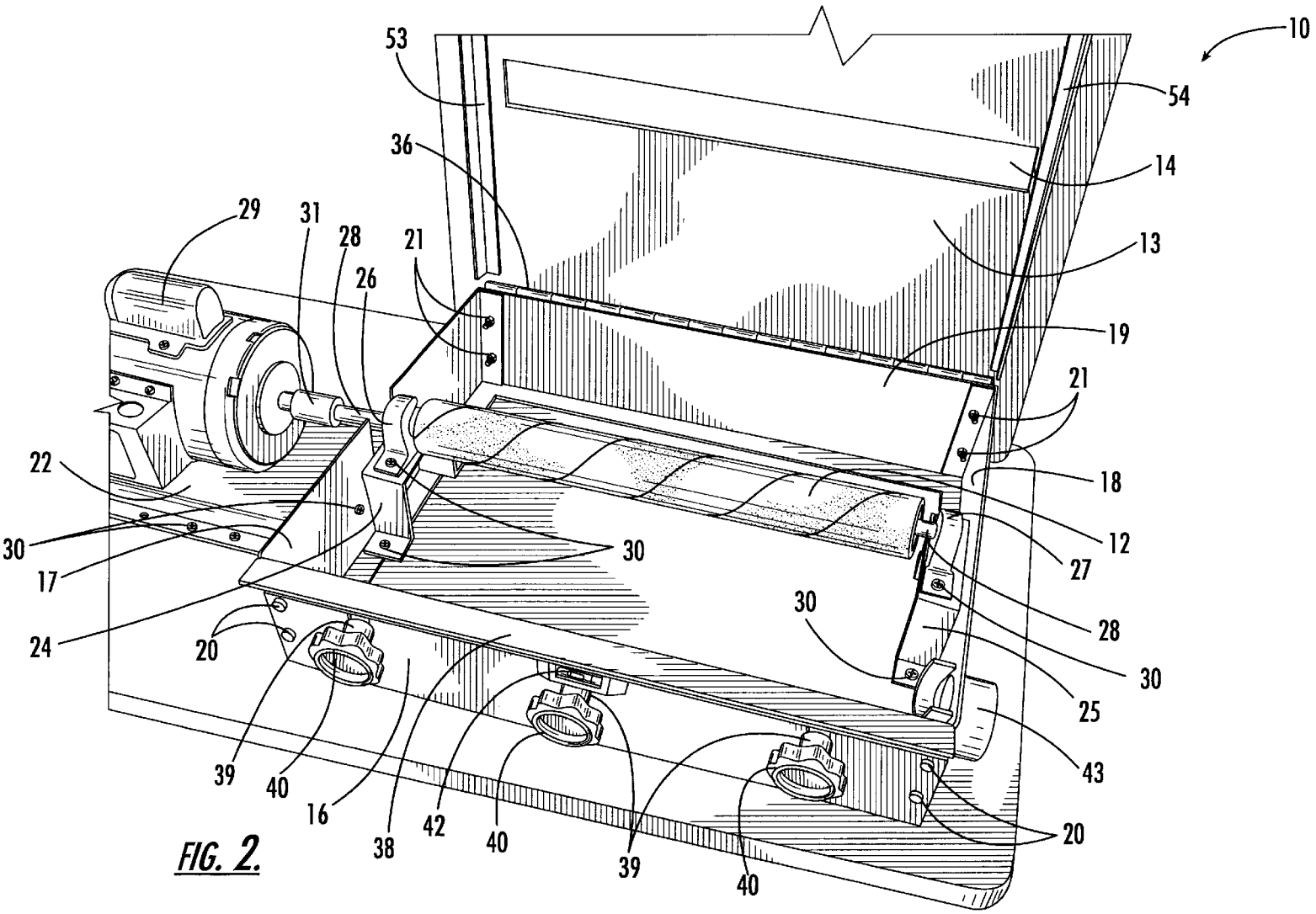
FIG. 2 is a perspective view of the preferred portable drum sander shown in FIG. 1, with the feed table in an upright position.

As shown in FIG. 2, front plate 16, left side plate 17, right side plate 18, and rear plate 19 are interconnected by machine screws 20 and lock nuts 21, or other fasteners, to form the base 11. A motor base 22 is connected to left side plate 17 with fasteners such as socket head screws and lock nuts. The base plates 16, 17, 18, 19 and the motor base 22 are attached to a support surface 23, preferably made of wood. Pillow block support brackets 24, 25 are attached at the center of the interior sides of side plates 17, 18, respectively. Pillow block bearings 26, 27 are mounted on top of support brackets 24, 25, respectively. An elongate shaft 28 runs through the center of drum 12. Opposite ends of the drum shaft 28 are positioned within the pillow block bearings 26, 27.

Figures 4, 4A:
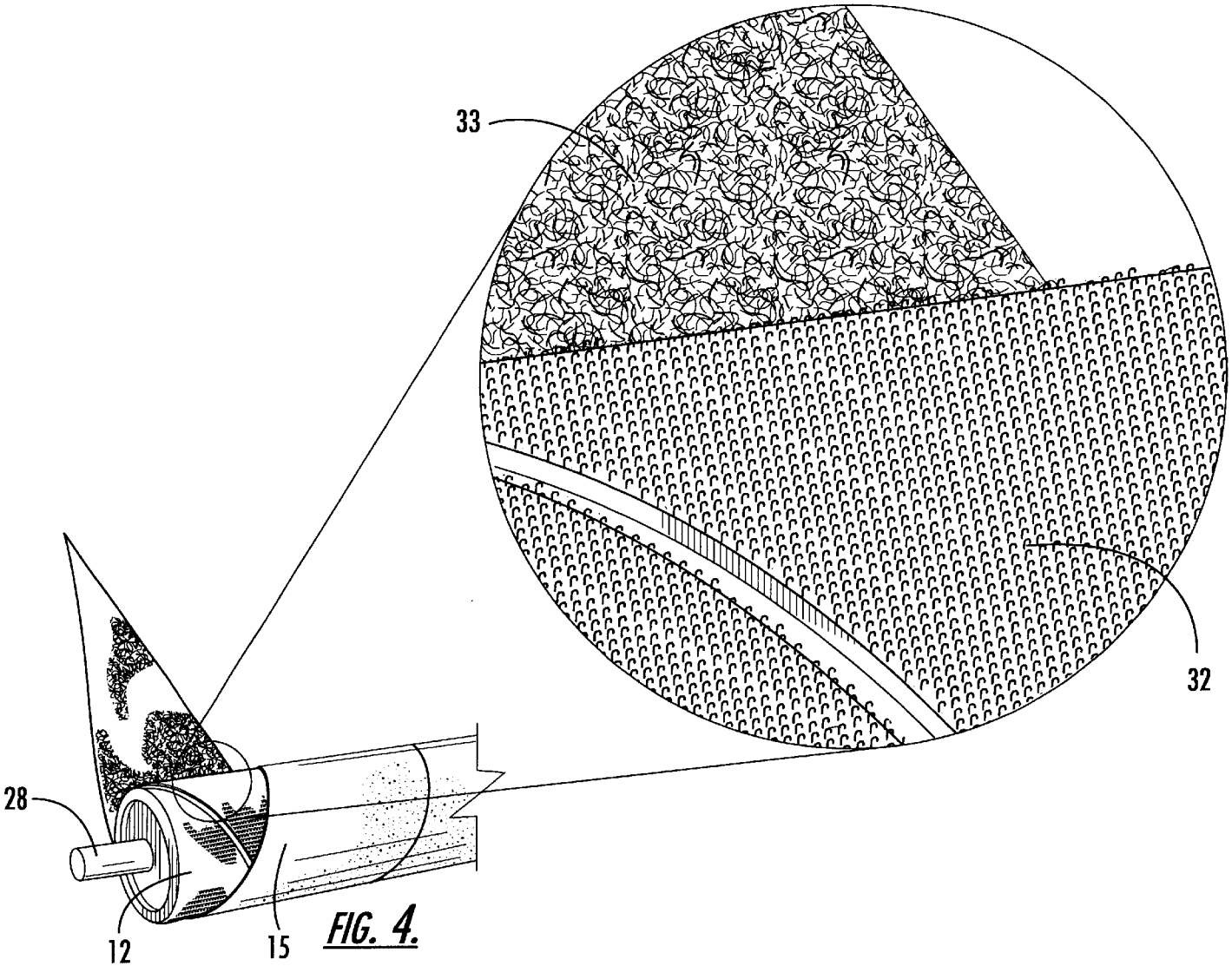
FIG. 4 is a partial perspective view of a preferred sanding drum and sandpaper according to the invention.
FIG. 4*a* is an enlarged view of the outer surface of the sanding drum and under surface of the sandpaper shown in FIG. 4.

A motor 29, preferably ⅓ horsepower, is mounted on motor base 22, which is attached to wood surface 23 and left side plate 17 by socket head screws 30. The motor 29 includes a shaft connector 31 into which the left side of the drum shaft 28 is positioned, enabling the motor 29 to rotate the drum 12. The drum 12 is preferably 18 inches long and has a plurality of closely-spaced flexible hooks 32 adapted for receiving a sheet of sanding paper 15 that has a plurality of mating filament loops 33 on the backside, as shown in FIGS. 4 and 4*a*.

Figure 5:
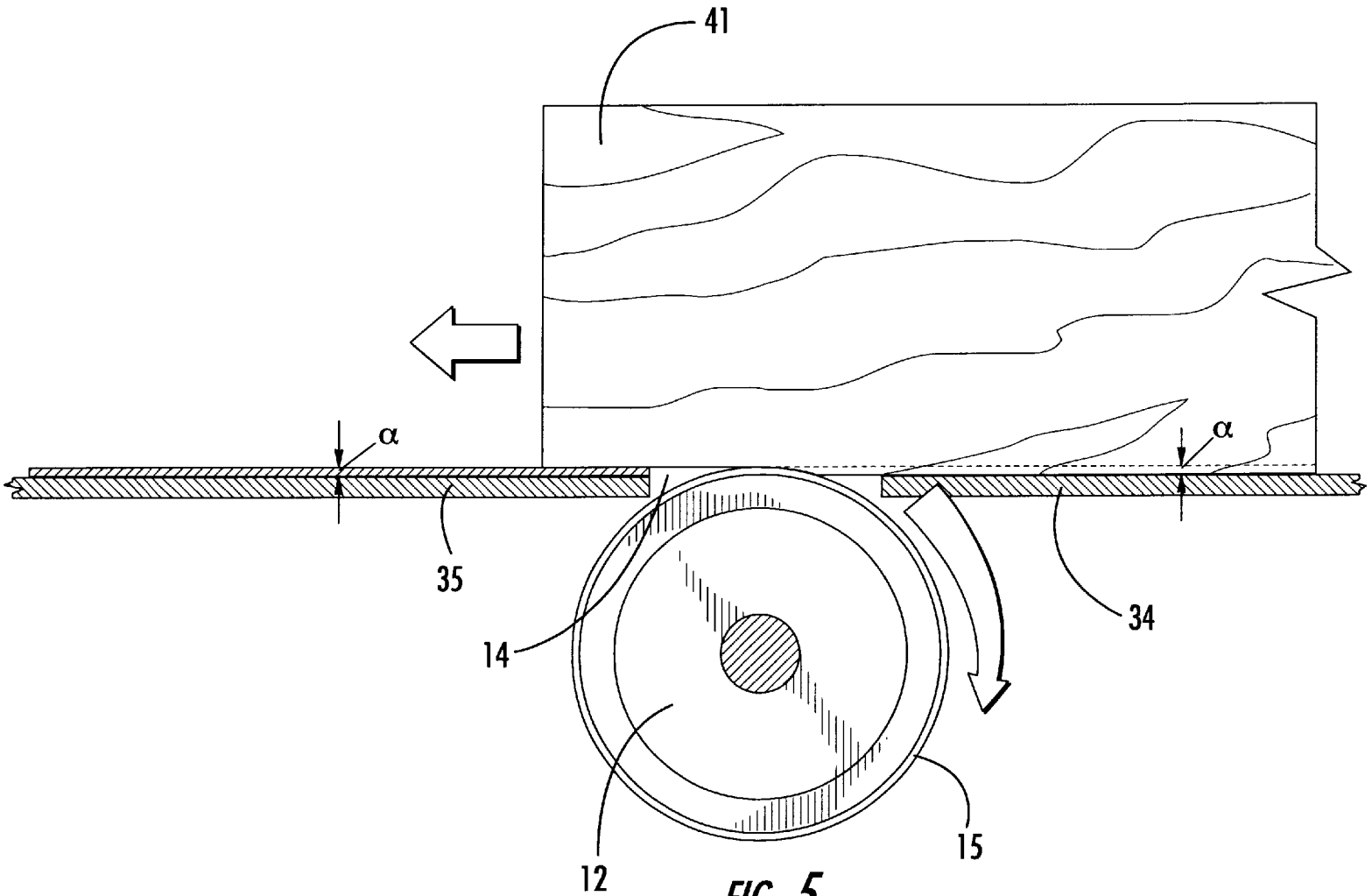
FIG. 5 is a partial side elevation of the workpiece, feed table and sanding drum shown in FIG. 1.

Rectangular slot 14 extends through the middle of the feed table 13, which is preferably square. The slot 14 defines an infeed segment 34 on one side and an outfeed segment 35 on the opposite side of the slot 14. On the underside of the feed table 13, an elongate hinge 36 is attached proximate the outer edge of the outfeed segment 35 and extends parallel to the slot 14. The hinge 36 connects the feed table 13 to the rear base plate 19 and enables the feed table 13 to be pivoted to an upright position as shown in FIG. 2. The upper surface of the outfeed segment 35 is offset slightly higher relative to the upper surface of the infeed segment 34, by a predetermined height $\alpha$, preferably 0.01–0.02 inches, as shown in FIG. 5.

Three laterally spaced-apart, vertically oriented slots 37, preferably ½ inch long by ¼ inch wide, are formed within front plate 16. A front lifter plate 38 has three circular threaded holes (not shown) laterally spaced-apart to correspond with the three slots of the front plate 16. The front lifter plate 38 has a vertical portion, in which the holes are formed, that is positioned against the interior side of the front plate 16, and a horizontal lip segment that extends over the top of the front plate 16 and outwardly to support the feed table 13 as shown in FIG. 1. The front plate 16 and lifter plate 38 are connected by bolts 39 extending through the slots 37 of the front plate 16 and into the holes of the lifter plate 38 to threadingly engage therewith. Each of the bolts 39 include an enlarged head 40 having peripheral indentations to facilitate manual rotation of the bolts. When the bolts 39 are tightened, by clockwise rotation, the front plate 16 is held firmly in position against the lifter plate 38.

The height of the feed table 13 can be adjusted by elevating or lowering the lifter plate 38. This is accomplished by loosening the bolts 39 to allow the lifter plate 38 to move vertically within the length of the slots 37 in the front plate 16. When the lifter plate 38 is at the desired height, the bolts are tightened again to lock the lifter plate 38 into position. A level 42, such as a bubble level, is mounted on the lifter plate 38 to assist the user when tightening the three bolts 39 so that the lifter plate 38 resides in a level horizontal plane. By varying the height of the feed table 13, the exposure of sanding drum 12 through rectangular slot 14 can be adjusted to obtain a desired amount of sanding in a single pass.

As shown in FIG. 1, the feed table 13 rests on the front lifter plate 38, the left side plate 17, the right side plate 18 and the rear plate 19. Elongate L-shaped support brackets 53, 54, shown in FIG. 2, are attached in parallel alignment on the underside of feed table 13 so that the support brackets 53, 54 are adjacent to the left side plate 17 and right side plate 18, respectively, when the feed table is in the down position shown in FIG. 1. The support brackets stabilize the feed table 13 on the side plates 17, 18 by preventing lateral movement of the feed table 13, and provide added strength to prevent bending of the feed table 13. If needed, a third support bracket could be added proximate the front edge of the feed table extending perpendicularly to support brackets 53, 54.

To operate the sander 10, the motor 29 is activated and rotates the sanding drum 12, which has sanding paper 15 affixed thereon. A workpiece 41, typically a piece of wood, is moved across the infeed segment 34 of the feed table 13 and over the drum 12 for sanding, while applying sufficient pressure to keep the workpiece firmly on the feed table 13. The sander 10 can sand a workpiece 41 of any height, because there is no top cover as with conventional planers and jointers. The workpiece 41 is moved over the drum 12 and onto the outfeed segment 35 of the feed table 13. As the workpiece 41 moves across the drum 12 and is sanded, the slight upward offset a of the outfeed segment 35 facilitates steady movement of the workpiece 41 across the drum 12 by keeping the portion of the workpiece 41 that has been sanded by the drum 12 horizontally level with the portion remaining on the infeed segment 34 which has not yet been sanded. The offset distance $\alpha$ between the infeed segment 34 and the outfeed segment 35 is approximately equal to the depth of material removed from workpiece 41 by the sanding action of drum 12, as shown in FIG. 5. A dust port 43, preferably connected to a vacuum system or cleaner, is formed within right side plate 18 to allow for evacuation of dust that accumulates below the feed table 13. The feed table 13 can be moved to an upright position, as shown in FIG. 2, for jobs where it is useful to have more access to the drum, as in sanding tight curves and scrollwork.

Figure 6:
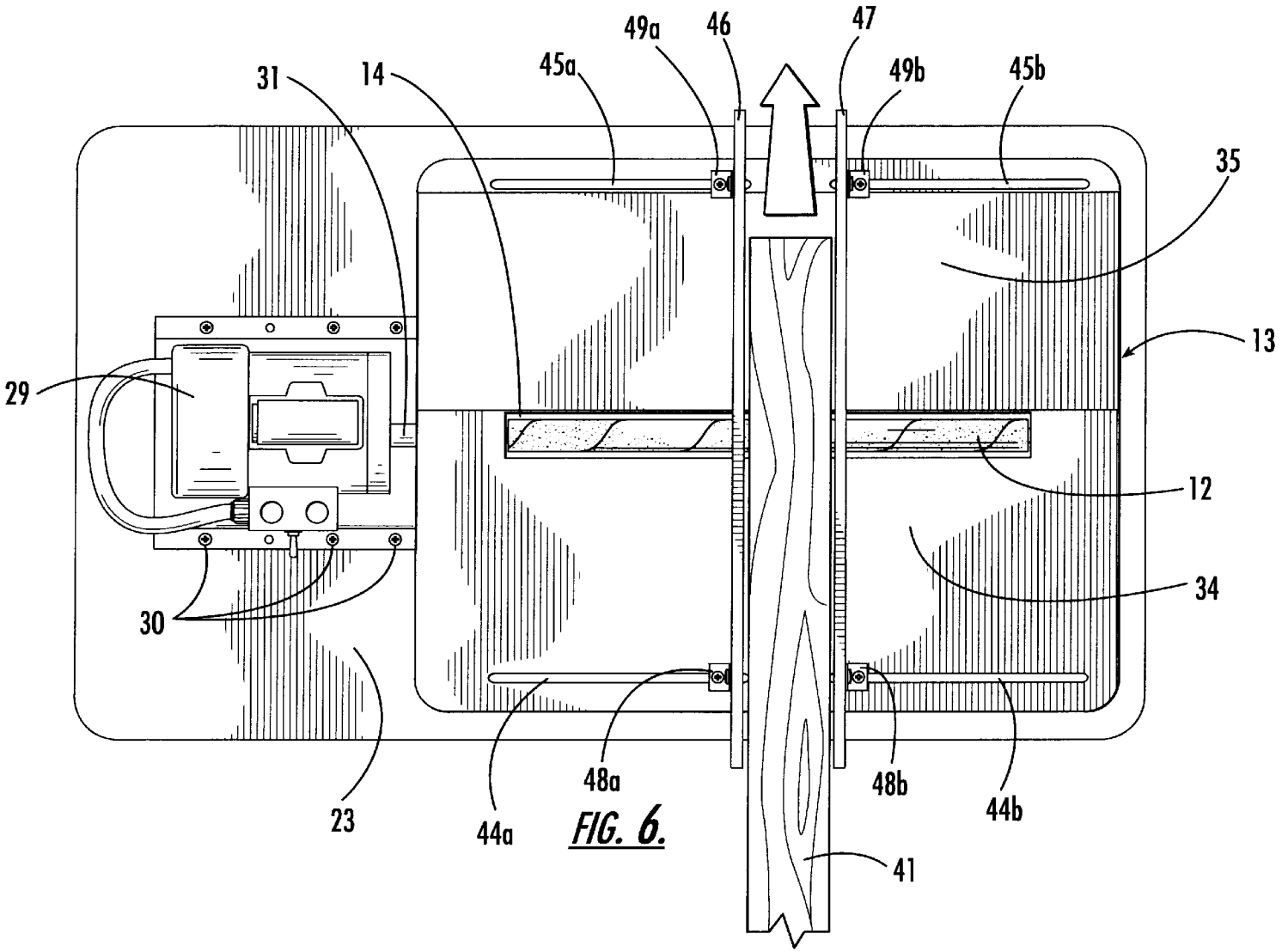
FIG. 6 is a top plan view of the preferred portable drum sander shown in FIG. 1, with guide fences mounted on the feed table.

As shown in FIG. 6, guide fences 46, 47 can be mounted on the feed table 13 for facilitating steady and straight movement of the workpiece 41 across the sanding drum 12. Two pairs of laterally extending slots 44*a*, 44*b*, 45*a*, 45*b* are formed in the feed table 13 for mounting the guide fences 46, 47. One pair of slots 44*a*, 44*b* are formed proximate the edge of the infeed segment 34, while the other pair 45*a*, 45*b* are positioned proximate the edge of the outfeed segment 35. One guide fence 46 is attached to two right angle fence brackets 48*a*, 49*a* that are mounted within slots 44*a*, 45*a*, respectively, and the other guide fence 47 is attached to two right angle fence brackets 48*b*, 49*b* mounted within slots 44*b*, 45*b*, respectively. The guide fences 46, 47 extend perpendicularly to the slots 44*a*, 44*b*, 45*a*, 45*b*, and the sanding drum 12. The workpiece 41 is moved between the guide fences 46, 47, which provide stability and facilitate straight movement of the workpiece 41 across the drum 12. The brackets 48*a*, 48*b*, 49*a*, 49*b* can be moved to different positions along the respective slots 44*a*, 44*b*, 45*a*, 45*b* to adjust the distance between the two guide fences 46, 47 to accommodate workpieces of varying size, or to move the guide fences 46, 47 to alter the position on the sanding drum 12 at which the workpiece 41 makes contact.

Figure 7:
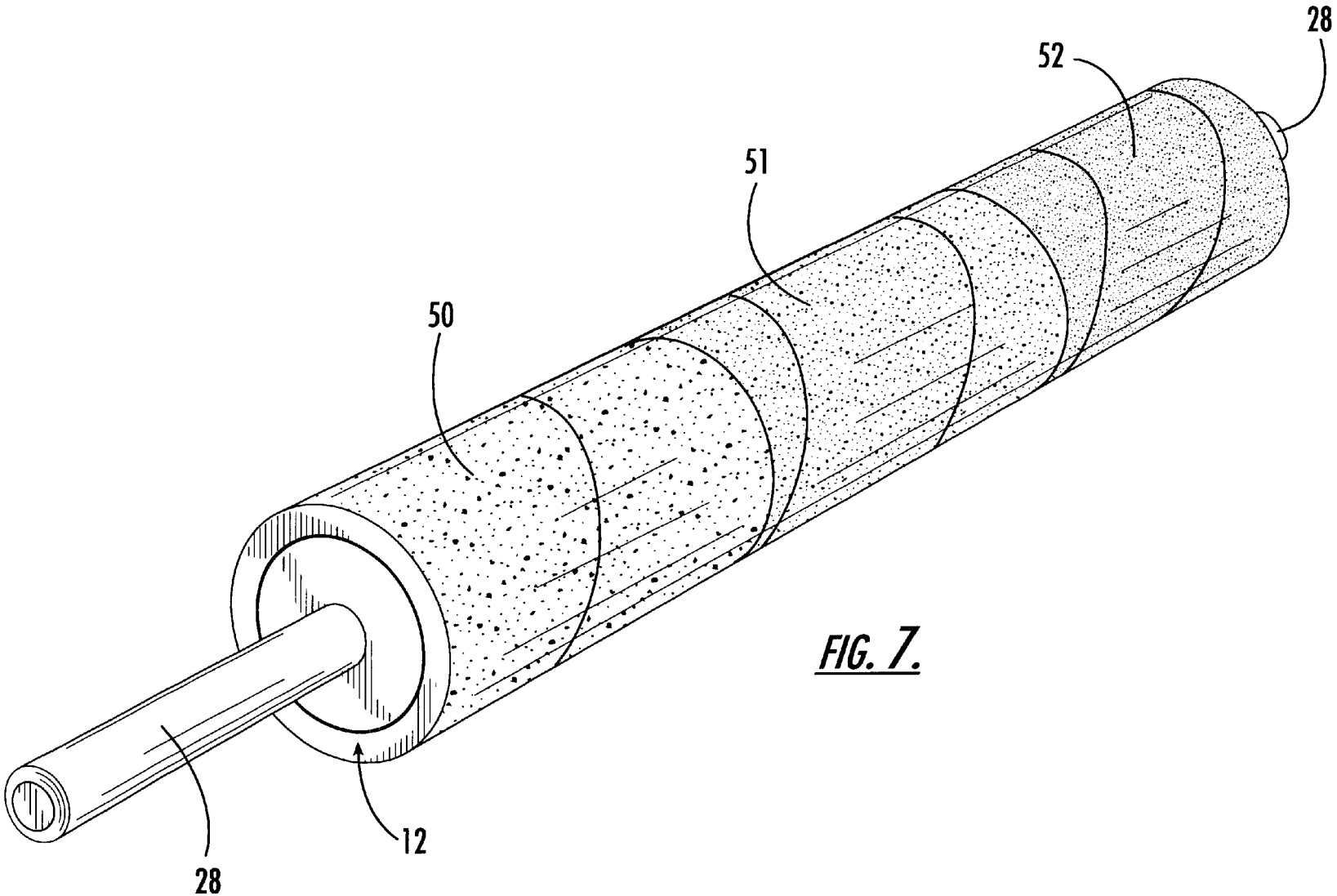
FIG. 7 is a perspective view of a preferred sanding drum according to the invention, having three different grades of sandpaper positioned thereon.

As shown in FIG. 7, the drum 12 preferably carries three different grades of sand paper at once. A heavy grit paper 50, medium grit paper 51, and light grit paper 52 are simultaneously attached to the drum 12 so that the user need not expend time stopping the motor 29, removing the drum 12 and changing sandpapers every time a different grit is desired. The various grits 50, 51, 52 are on separate sheets of sandpaper. Each of the sandpaper sheets 50, 51, 52 are cut at a diagonal angle at opposing ends so that the sheets 50, 51, 52 can be spirally wrapped around the drum 12 and remain perpendicular to the longitudinal axis of the drum 12. The sandpaper sheets 50, 51, 52 are wrapped so that drum 12 is continuously covered with sandpaper and there is no exposed gaps between the sandpaper sheets 50, 51, 52.

A portable drum sander is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A portable drum sander, comprising:

(a) a base;

(b) a drum mounted for rotation on the base and adapted for receiving and simultaneously carrying at least two different grades of sandpaper side-by-side on a peripheral surface thereof;

(c) a feed table carried on the base and having a slot therein through which the drum is exposed for rotating contact with a workpiece to be sanded, said feed table including an infeed table segment upstream of the slot and an outfeed table segment downstream of the slot for supporting the workpiece during passage over the slot in contact with the drum;

(d) a pivot mounting the feed table adjacent a downstream end of the outfeed table segment for pivotal movement of the feed table to a desired height with reference to the drum; and (e) a height adjustment lock cooperating with the infeed table segment for locking the feed table into a locked position at the desired height with reference to the drum.

2. A portable drum sander comprising:

(a) a base having interconnected front, rear and left and right side plates forming a frame;

(b) a drum mounted for rotation on the base for carrying at least one grade of sandpaper on a peripheral surface thereof, said drum extending across said frame;

(c) a feed table carried on the base and having a slot therein through which the drum is exposed for rotating contact with a workpiece to be sanded, said feed table including an infeed table segment upstream of the slot and an outfeed table segment downstream of the slot for supporting the workpiece during passage over the slot in contact with the drum;

(d) a pivot mounting the feed table adjacent a downstream end of the outfeed table segment for pivotal movement of the feed table to a desired height with reference to the drum; and (e) a height adjustment lock cooperating with the infeed table segment for locking the feed table into a locked position at the desired height with reference to the drum, said height adjustment lock comprising:

(i) a lifter plate supporting the feed table and mounted for vertical movement relative to the front plate of the base for varying the height of the feed table within a range of vertical motion relative to the drum; and (ii) at least one locking device carried by said front plate for locking the lifter plate into a desired position within the range of motion.

3. A portable drum sander comprising:

(a) a base;

(b) a drum mounted for rotation on the base for carrying at least one grade of sandpaper on a peripheral surface thereof;

(c) a feed table carried on the base and having a slot therein through which the drum is exposed for rotating contact with a workpiece to be sanded, said feed table including an infeed table segment upstream of the slot and an outfeed table segment downstream of the slot for supporting the workpiece during passage over the slot in contact with the drum;

(d) a pivot mounting the feed table adjacent a downstream end of the outfeed table segment for pivotal movement of the feed table to a desired height with reference to the drum;

(e) a height adjustment lock cooperating with the infeed table segment for locking the feed table into a locked position at the desired height with reference to the drum; and (f) a plurality of laterally-extending slots in the infeed table segment and in the outfeed table segment for mounting a guide fence.

4. A portable drum sander comprising:

(a) a base having interconnected front, rear and left and right side plates forming a frame;

(b) a drum mounted for rotation on the base for carrying at least one grade of sandpaper on a peripheral surface thereof, said drum extending across said frame;

(c) a feed table mounted on said base and having a slot therein through which the drum is exposed for rotating contact with a workpiece to be sanded, said feed table including an infeed table segment upstream of the slot and an outfeed table segment downstream of the slot for supporting the workpiece during passage over the slot in contact with the drum;

(d) a pivot mounting the feed table adjacent a downstream end of the outfeed table segment for pivotal movement of the feed table to a desired height with reference to the drum;

(e) a height adjustment lock cooperating with the infeed table segment for locking the feed table into a locked position at the desired height with reference to the drum;

(f) a lifter plate supporting the feed table and mounted for vertical movement relative to the front plate of the base for varying the height of the feed table within a range of vertical motion relative to the drum, said lifter plate supporting the feed table adjacent an upstream end of the infeed segment of the feed table;

(g) at least one locking device carried by said front plate for locking the lifter plate into a desired position within the range of motion; and (h) wherein said front plate includes at least two laterally spaced-apart, vertically-oriented slots, and said locking device comprises at least first and second bolts extending, respectively, through the at least two slots and threaded to the lifter plate, the bolts each being rotatable between the locked position and an unlocked position for adjusting the height of the feed table.

5. A portable drum sander according to claim 1 or 2, and including a motor mounted on the base and connected to the drum for supplying power to rotate the drum.

6. A portable drum sander according to claim 1 or 3, wherein the peripheral surface of the drum is covered with a multiplicity of closely-spaced flexible hooks adapted for receiving sanding paper having a multiplicity of mating filament loops carried on the back thereof.

7. A portable drum sanding to claim 2, wherein:

(a) said lifter plate supports the feed table adjacent an upstream end of the infeed segment of the feed table;

(b) said front plate includes at least one vertically-oriented slot; and (c) said locking device comprises a bolt extending through the slot and threaded to the lifter plate, the bolt being rotatable between the locked position and an unlocked position for adjusting the height of the feed table.

8. A portable drum sander according to claim 3, wherein the plurality of laterally-extending slots comprise a first pair of laterally-extending slots in the infeed segment, and a second pair of laterally-extending slots in the outfeed segment, each of said slots for receiving a mounting bracket therein, said mounting brackets for supporting a guide fence on the feed table.

9. A portable drum sander according to claim 8, wherein said mounting brackets support two guide fences on the feed table, said guide fences positioned on said feed table for guiding the workpiece across said drum.

10. A portable drum sander according to claim 9, wherein said mounting brackets are moveable along said laterally-extending slots to vary the area between the two guide fences.

11. A portable drum sander according to claim 4, wherein the locking device comprises three bolts extending, respectively, through three slots and threaded to the lifter plate, the bolts each being rotatable between the locked position and an unlocked position for adjusting the height of the feed table.

12. A portable drum sander according to claim 4, wherein said bolts include enlarged heads with peripheral indentations thereon for permitting manual rotation of the bolts.

13. A portable drum sander according to claim 4, wherein the outer peripheral surface of the drum is covered with a multiplicity of closely-spaced flexible hooks adapted for receiving sanding paper having a multiplicity of mating filament loops carried on the back thereof.

14. A portable drum sander according to claim 4 or 3, and including a dust port positioned in one of the left or right side plates.

15. A portable drum sander according to claim, 4 or 3, wherein said feed table is exposed for permitting sanding of workpieces without a height limitation.

16. A portable drum sander according to claim, 4 or 3, wherein the outfeed table segment is upwardly vertically offset relative to the infeed table segment.

17. A portable drum sander according to claim 4 or 3, and including a motor mounted on the base and connected to the drum for supplying power to rotate the drum.

18. A portable drum sander according to claim 4 or 13, wherein said drum is adapted for receiving and simultaneously carrying at least two different grades of sandpaper side-by-side for permitting first and second sanding steps to be carried out on the sander without changing sandpaper.

19. A portable drum sander according to claim 2 or 4, wherein said lifter plate comprises a vertical segment positioned against an interior surface of said front plate, and a horizontal lip segment extending over a top edge of the front plate and outward to support said feed table, said bolts threaded to said vertical segment.

* * * * *